US008308516B2

(12) United States Patent
Gassaur et al.

(10) Patent No.: US 8,308,516 B2
(45) Date of Patent: Nov. 13, 2012

(54) SPRING TERMINAL ELEMENT AND TERMINAL BLOCK

(75) Inventors: Stephan Gassaur, Ilfeld (DE); Jan Steussloff, Sondershausen (DE); Frank Hartmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/117,392

(22) Filed: May 27, 2011

(65) Prior Publication Data

US 2012/0028483 A1 Feb. 2, 2012

(30) Foreign Application Priority Data

Jun. 11, 2010 (DE) ..... 10 2010 023 423

(51) Int. Cl.
*H01R 4/48* (2006.01)

(52) U.S. Cl. ..... 439/817

(58) Field of Classification Search ..... 439/709, 439/712, 811, 812, 817
See application file for complete search history.

(56) References Cited

U.S. PATENT DOCUMENTS

| | | | | | |
|---|---|---|---|---|---|
| 1,204,457 | A * | 11/1916 | Kreeft | 439/817 |
| 2,360,304 | A * | 10/1944 | McLoughlin et al. | 439/739 |
| 3,304,392 | A * | 2/1967 | Isler | 337/152 |
| 3,806,860 | A * | 4/1974 | Flammini | 439/817 |
| 3,989,345 | A * | 11/1976 | DeVito | 439/729 |
| 4,040,712 | A * | 8/1977 | Dahlstrom | 439/691 |
| 4,907,989 | A * | 3/1990 | Huska | 439/812 |
| 5,030,139 | A * | 7/1991 | Huska | 439/513 |
| 5,041,901 | A * | 8/1991 | Kitano et al. | 257/779 |
| 6,379,197 | B2 * | 4/2002 | Matsuda et al. | 439/801 |
| 6,478,605 | B2 * | 11/2002 | Stuckmann et al. | 439/409 |
| 6,916,213 | B2 * | 7/2005 | Nyblin et al. | 439/709 |
| 7,029,336 | B2 * | 4/2006 | Cox | 439/709 |
| 7,033,231 | B2 * | 4/2006 | Lu | 439/812 |
| 8,105,118 | B2 * | 1/2012 | Claprood, Jr. | 439/709 |
| 8,206,186 | B2 * | 6/2012 | Kisic et al. | 439/709 |
| 2002/0042231 | A1 * | 4/2002 | Brooks et al. | 439/709 |
| 2005/0130508 | A1 * | 6/2005 | Yeh | 439/709 |
| 2008/0070450 | A1 * | 3/2008 | Pizzi | 439/709 |
| 2011/0065330 | A1 * | 3/2011 | Miller et al. | 439/709 |
| 2011/0294363 | A1 * | 12/2011 | Yeh | 439/709 |

FOREIGN PATENT DOCUMENTS

| | | |
|---|---|---|
| DE | 195 13 281 Al | 10/1996 |
| DE | 198 17 924 Al | 10/1999 |
| DE | 600 07 149 T2 | 8/2004 |
| DE | 10 2008 008 651 | 8/2008 |

* cited by examiner

*Primary Examiner* — Neil Abrams
*Assistant Examiner* — Phuongchi Nguyen
(74) *Attorney, Agent, or Firm* — Whitham Curtis Christofferson & Cook, PC

(57) ABSTRACT

A spring terminal element, with a tensioning bracket mounted on a busbar piece such that it can move relative to the busbar piece has at least one clamping edge which engages under the busbar piece for clamping an electrical conductor between the clamping edge and the busbar piece and a helical spring which is operatively connected to the busbar piece and to the tensioning bracket. An operating cylinder can rotate and be fixed in position in the direction of the operating cylinder on the tensioning bracket or on the busbar piece. The screw thread on the operating cylinder engages with a screw thread on an operating section which is coupled to the tensioning bracket or to the busbar piece in order to move the tensioning bracket relative to the busbar piece during rotation of the operating cylinder.

14 Claims, 8 Drawing Sheets

SPRING TERMINAL ELEMENT AND TERMINAL BLOCK

The invention relates to a spring terminal element having a busbar piece, a tensioning bracket, which is mounted on the busbar piece such that it can move relative to the busbar piece and has at least one clamping edge, which engages under the busbar piece, for clamping an electrical conductor between the clamping edge and the busbar piece, and a helical spring, which is operatively connected to the busbar piece and to the tensioning bracket and exerts a spring force between the tensioning bracket and the busbar piece.

The invention also relates to a terminal block having an insulating material housing and having at least one spring terminal element which is held in the insulating material housing.

Such tensioning bracket spring force terminals are particularly suitable for high-current applications. The helical spring can exert an adequate clamping force on the clamping edge of the tensioning bracket, and can therefore exert a clamping effect, which is suitable for high current, on an electrical conductor which rests on the clamping edge.

DE 198 17 924 C2 discloses a high-current terminal having a tensioning bracket spring force terminal connection such as this. In order to open the clamping point, the tensioning bracket is pushed downward with the aid of a forward-movement rotation cylinder, and the helical compression spring is compressed in the process. The forward-movement rotation cylinder is in this case guided in the insulating material housing of the high-current terminal.

When the forward-movement rotation cylinder has been moved down to the maximum extent, it can be secured in the open end position by a bolt which can be moved against the restoring force of the spring.

DE 10 2008 008 651 A1 describes an electrical terminal having a spring terminal connection in the form of a cage tension spring. The cage tension spring is inserted into a contact cage, and the clamping limbs of the cage tension spring can be moved via a threaded screw. The threaded screw is mounted in a fixed position and such that it can rotate in the insulating material housing of the terminal, and interacts with a threaded nut, which is guided in a rotationally secure manner, but such that it can be moved longitudinally, in the insulating material housing. The opening in the terminal connection for holding the electrical conductor is produced by pulling the threaded nut on the clamping limb of the cage tension spring.

DE 600 07 149 T2 describes a connecting terminal having a tensioning bracket spring terminal connection, in which a pin which is mounted such that it can rotate and has a screw surface on the external circumference is inserted between two sleeves with a corresponding screw surface. One sleeve rests on the tensioning bracket, while the other sleeve is formed integrally with the insulating material housing. The tensioning bracket can be adjusted by rotation of the operating pin, with the screw surfaces sliding on one another.

Furthermore, DE 195 13 281 A1 discloses a connecting terminal having a stationary connecting bracket and a socket terminal which can be moved relative thereto. A compression spring is arranged between the socket terminal and the connecting bracket. The threaded shank of a clamping screw passes through a hole in the connecting bracket, and engages in a threaded shank in the socket terminal. The screw head of the clamping screw is supported in the form of a stop on the housing during operation, thus allowing the socket terminal to release the holding area. A greater opening in the holding area can be produced by pushing the clamping screw down.

The known spring force terminal connection with a tensioning bracket is subject to the problem of operating the tensioning bracket connection by application of force to the insulating material housing. The connecting terminals which are equipped with such tensioning bracket spring terminal connections therefore have to be made relatively solid, and this has a disadvantageous effect on physical size. Furthermore, the operating members occupy a relatively large amount of space above the tensioning bracket, which in turn increases the physical height.

The object of the present invention is therefore to provide an improved spring terminal element and an improved terminal block having a spring terminal element such as this.

The object is achieved by the spring terminal element of the type mentioned initially in that an operating cylinder with a screw thread is mounted such that it can rotate and fixed in position in the extent direction of the operating cylinder on the tensioning bracket or on the busbar piece, wherein the operating cylinder is arranged with its screw thread essentially in the internal area of the tensioning bracket, at least in the clamping state when it is clamped on an electrical conductor, and wherein the screw thread on the operating cylinder engages with a screw thread on an operating section, which is coupled to the tensioning bracket or to the busbar piece, in order to move the tensioning bracket relative to the busbar piece during rotation of the operating cylinder.

According to the teaching of the present invention, the screw thread on an operating cylinder extends into the internal area of the tensioning bracket, at least in the clamping state. In this case, the operating cylinder is mounted such that it can rotate but in a fixed position in its extent direction on the tensioning bracket or on the busbar piece. The helical spring is axially loaded or unloaded by relative movement between the operating cylinder and the operating section with respect to one another during rotation of the operating cylinder, thus opening or closing the spring terminal element. Because the operating cylinder is held in the internal area of the tensioning bracket, the action area which is required to operate the spring terminal element is moved into the unused internal area of the tensioning bracket. There is no need for additional physical space for the operating member above the tensioning bracket.

Furthermore, the operating cylinder provides a self-supporting spring terminal element, in which the operating member need no longer be supported on the insulating material housing of a terminal block, in order to allow operation of the spring terminal element. When the operating cylinder and the operating section are rotating relative to one another, the operating force is absorbed by the tensioning bracket, because the operating cylinder is borne on the tensioning bracket, and by the spring terminal element itself, by the mating operating piece being borne directly or indirectly on the helical spring.

This allows the design of the insulating material housing for a terminal block to be simplified without having to make it solid and reinforced.

It is particularly advantageous for the operating cylinder to have an external thread and for the operating section in the mating operating piece to be in the form of a sleeve with an internal thread. The operating cylinder then enters the sleeve, and its external thread interacts with the internal thread in the sleeve.

The opposite variant is, of course, also feasible, in which the operating cylinder has an internal thread, and the mating operating piece has an external thread which engages in an internal area in the operating cylinder, in order to produce a relative movement between the operating bolt and the mating operating piece when one of the two parts is rotated.

It is particularly advantageous for the screw thread in the operating cylinder to extend into the internal area of the helical spring, thus using the internal area of the helical spring as a holding area.

In this case, furthermore, the operating section, in particular the sleeve, may furthermore have, for example, a projection on its external circumference, with the helical spring resting on this projection. The sleeve and the operating cylinder therefore enter the internal area of the helical spring thus making use of this space which has been unused until now, and significantly reducing the physical size of the spring terminal element in comparison to the conventional solutions.

In the same manner, the operating cylinder may have a projection on its external circumference, and the tensioning bracket can rest on this projection. The projections may be provided in at least one subarea of the external circumference or else, if required, may be circumferential with a varying depth all round the external circumference.

Alternatively, it is also feasible for the helical spring to be held in the internal area of the sleeve and to be arranged between the free end of the operating cylinder, which enters the sleeve, and the bottom of the sleeve. In this case, the otherwise unused internal area of the sleeve is used as a holding area, and a small physical size is likewise achieved. In this case, the helical spring acts against the bottom of the sleeve and against the end face of the operating cylinder, that is to say of the bolt.

It is particularly advantageous for a circumferential projection to have latching troughs and for a rotation block, which can be latched into the latching trough, to be provided in order to fix the operating cylinder against rotation in at least one end position. When a rotation block enters a latching trough, this prevents further rotation of the operating cylinder. Rotation such as this can occur in particular if the helical spring is prestressed and pressure is exerted on the operating cylinder, which would lead to an automatic rotational movement of the operating cylinder, and therefore to automatic closing of the spring terminal element.

It is particularly advantageous for a metal tunnel sheet to be attached to the busbar piece, providing a connecting area between the busbar piece and the inner wall, which is opposite the busbar piece, of the metal tunnel sheet. The helical spring and, if appropriate, the mating operating piece or the sleeve is mounted on a metal tunnel sheet. The connecting area between the inner wall of the metal tunnel sheet and the busbar piece can be used for introduction of a contact pin, for example of a lateral bridge. In order to allow a contact pin such as this to make reliable electrical contact with the metal tunnel sheet, and in particular with the busbar piece, it is particularly advantageous for a leaf spring to be arranged in the connecting area, for applying a contact pressure to a contact pin which can be inserted into the connecting area. This ensures that the spring force or insertion force is independent of a connected conductor.

The object is also achieved by a terminal block having an insulating material housing and having at least one spring terminal element, which is held in the insulating material housing, of the abovementioned type.

In this case, it is particularly advantageous for at least two clamping points to be provided on a common busbar piece. The clamping points are then each provided by a tensioning bracket and an operating member. The operating member is in each case formed by an associated pair of operating cylinders, which engage in one another, and an operating section having a screw thread.

It is also advantageous for a rotation block to in each case be mounted in the insulating material housing such that it can move, such that the rotation block engages with a latching trough in the operating cylinder in the end position of the tensioning bracket of a prestressed helical spring. In this way, the rotation block prevents the operating cylinder from rotating on its own, and therefore the spring terminal element being closed on its own.

The invention will be explained in more detail in the following text, with reference to exemplary embodiments and the attached drawings, in which.

Figure 1:
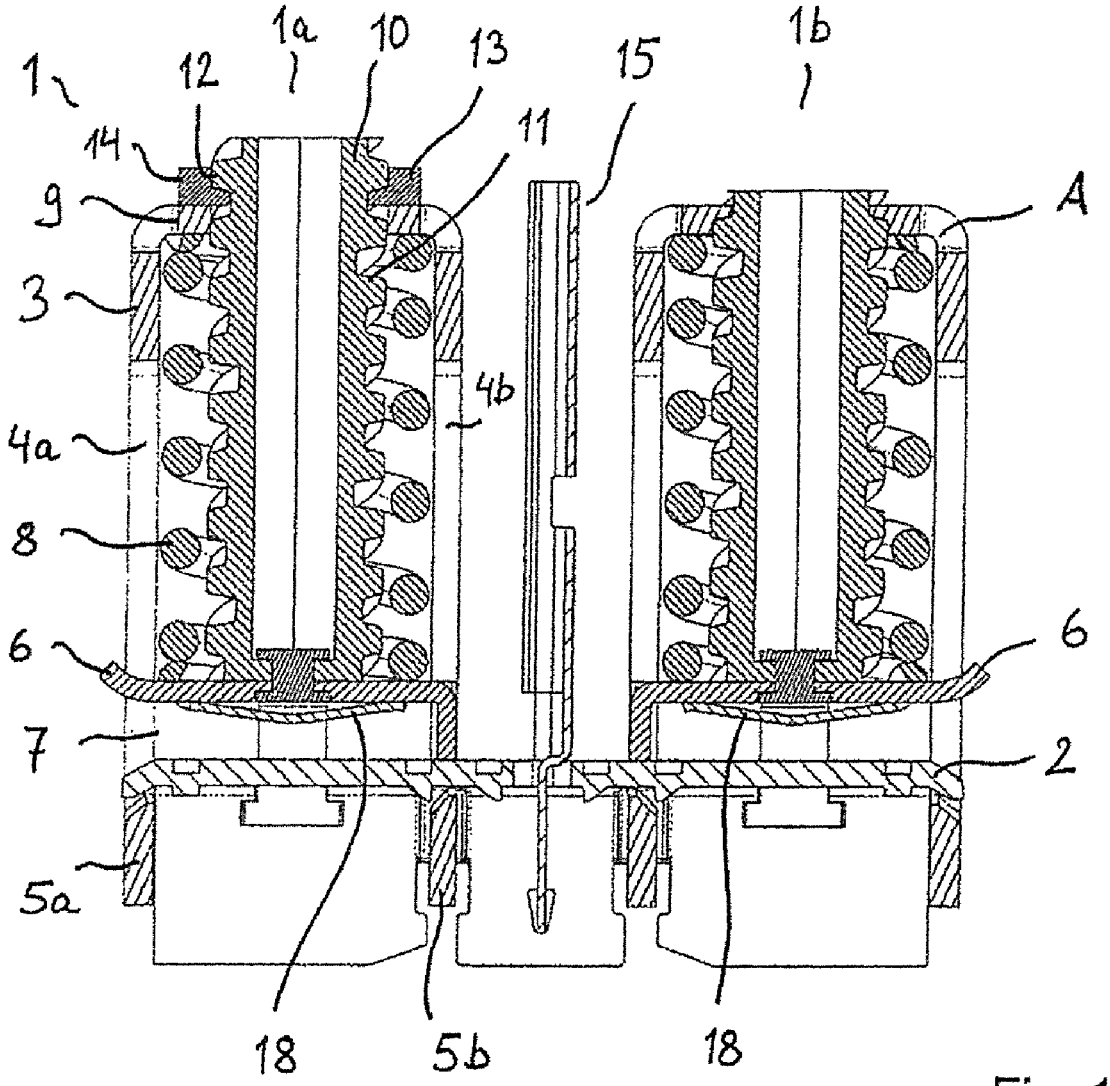
FIG. 1 shows a side section view of a first embodiment of two spring terminal elements arranged on a common busbar piece.

FIG. 1 shows a first embodiment of a spring terminal element 1. In the illustrated exemplary embodiment, there are two spring terminal elements 1*a*, 1*b* on a common busbar piece 2.

A spring terminal element 1*a*, 1*b* in each case uses a section of a busbar piece 2 in which a tensioning bracket 3 is mounted such that it can move. For this purpose, the tensioning bracket 3 has, for example, openings 4*a*, 4*b* on opposite side walls of the tensioning bracket 3, through which the busbar 2 is passed. The openings 4*a*, 4*b* are each bounded by clamping edges 5*a*, 5*b*, which are arranged under the busbar 2.

In the exemplary embodiment, the busbar piece 2 has a metal tunnel sheet 6 which, starting from the busbar piece 2, is curved in a section extending parallel to the busbar piece 2 such that a connecting area 7 is provided between the busbar piece 2 and the inner wall of the metal tunnel sheet 6. A helical spring 8 in the form of a helical compression spring is arranged above the metal tunnel sheet 6, its lower end rests on the metal tunnel sheet 6, and its upper end rests on an upper terminating wall 9 of the tensioning bracket 3. The force of the helical spring 8 pushes the tensioning bracket 3 upward in the axial direction of the helical spring 8, thus producing a clamping force between the clamping edges 5*a* and 5*b* and the busbar piece 2, in order to clamp in electrical conductors.

In order to allow the clamping point, which is formed between the clamping edges 5*a*, 5*b* and the busbar piece 2, to be opened in order to clamp in an electrical conductor, the helical spring 8 must be compressed. An operating cylinder 10 is provided for this purpose, which operating cylinder 10 extends into the internal area of the helical spring 8 and has a screw thread 11 in the form of an external thread in the external circumference. The screw thread 11 engages with a corresponding screw thread 12 on an operating section 13. The operating section 13 is provided on the terminating wall 9 by fitting a threaded nut 14 to the terminating wall 9, which threaded nut 14, together with the upper terminating wall 9, produces an internal thread.

The lower end of the operating cylinder 10 is mounted on the metal tunnel sheet 6 such that it can rotate, and is therefore fitted in a fixed position in the axial direction to the lower end of the helical spring 8, the metal tunnel sheet 6 and the busbar piece 2.

During rotation of the operating cylinder 10, the tensioning bracket 3 is moved downward in the axial extent direction of the operating cylinder 10 by the interaction between the screw thread 11 on the operating cylinder 10 and the screw thread 12 on the operating section 13, with the helical spring 8 being compressed, and with the distance between the clamping edges 5*a* and 5*b* and the busbar 2 being increased. In the process, the clamping point is opened for an electrical conductor, and an electrical conductor can be withdrawn.

Figure 2:
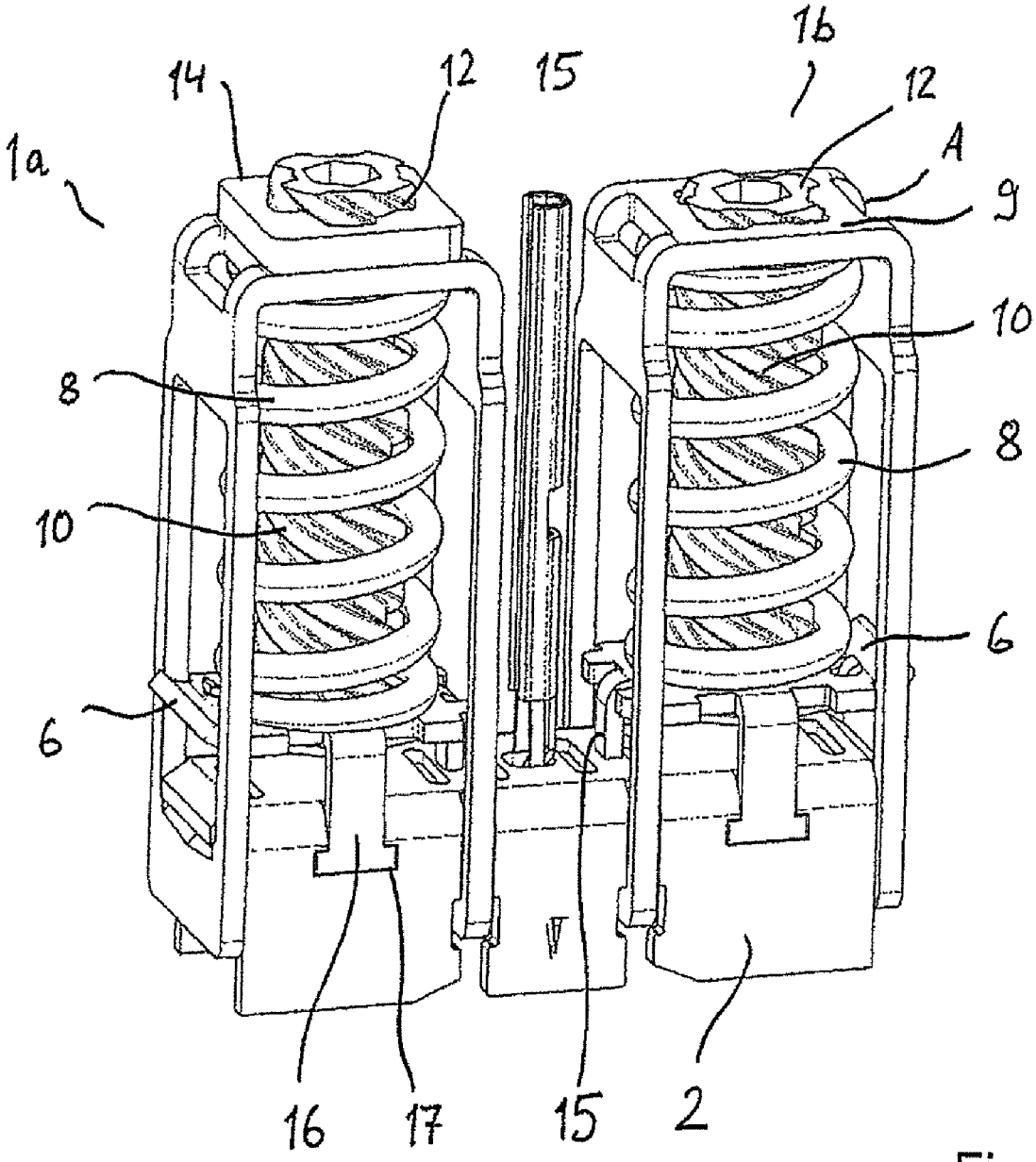
FIG. 2 shows a perspective front view of the spring terminal elements from FIG. 1.

FIG. 2 shows a perspective front view of the spring terminal elements 1*a*, 1*b* from FIG. 1. This clearly shows that the operating cylinder 10 in each case extends into the internal area of the helical spring 8, with a very large proportion of its length being held in the internal area, such that it therefore occupies only a very small amount of additional space.

It is also clear that no threaded nut element 14 is fitted to the upper terminating wall 9 in the spring terminal element 1*b*, that is to say the variant illustrated on the right. The screw thread 12 on the operating section 13 is in fact provided exclusively in the corresponding aperture opening in the terminating wall 9.

FIGS. 1 and 2 also show a depth stop 15, which extends between the two spring terminal elements 1*a*, 1*b*, parallel to the extent direction of the operating cylinder 10, into the busbar piece 2.

In the busbar piece 2, which is in the form of a box with an upper wall and two opposite side walls and possibly a lower wall, the depth stop 15 acts as a stop for an electrical conductor which has been inserted into the busbar piece 2. The depth stop 15 also acts as a test point on a terminal upper face.

FIG. 2 also shows that the metal terminal sheet 6 has a lug 16 which is suspended in a corresponding holding opening 17 in a side wall of the busbar piece 2, and is attached there.

It is also clear that the metal tunnel sheet has a foot, which is bent down in the direction of the busbar piece 2, in order to mount the metal tunnel sheet 6 on the busbar piece 2.

Figure 3:
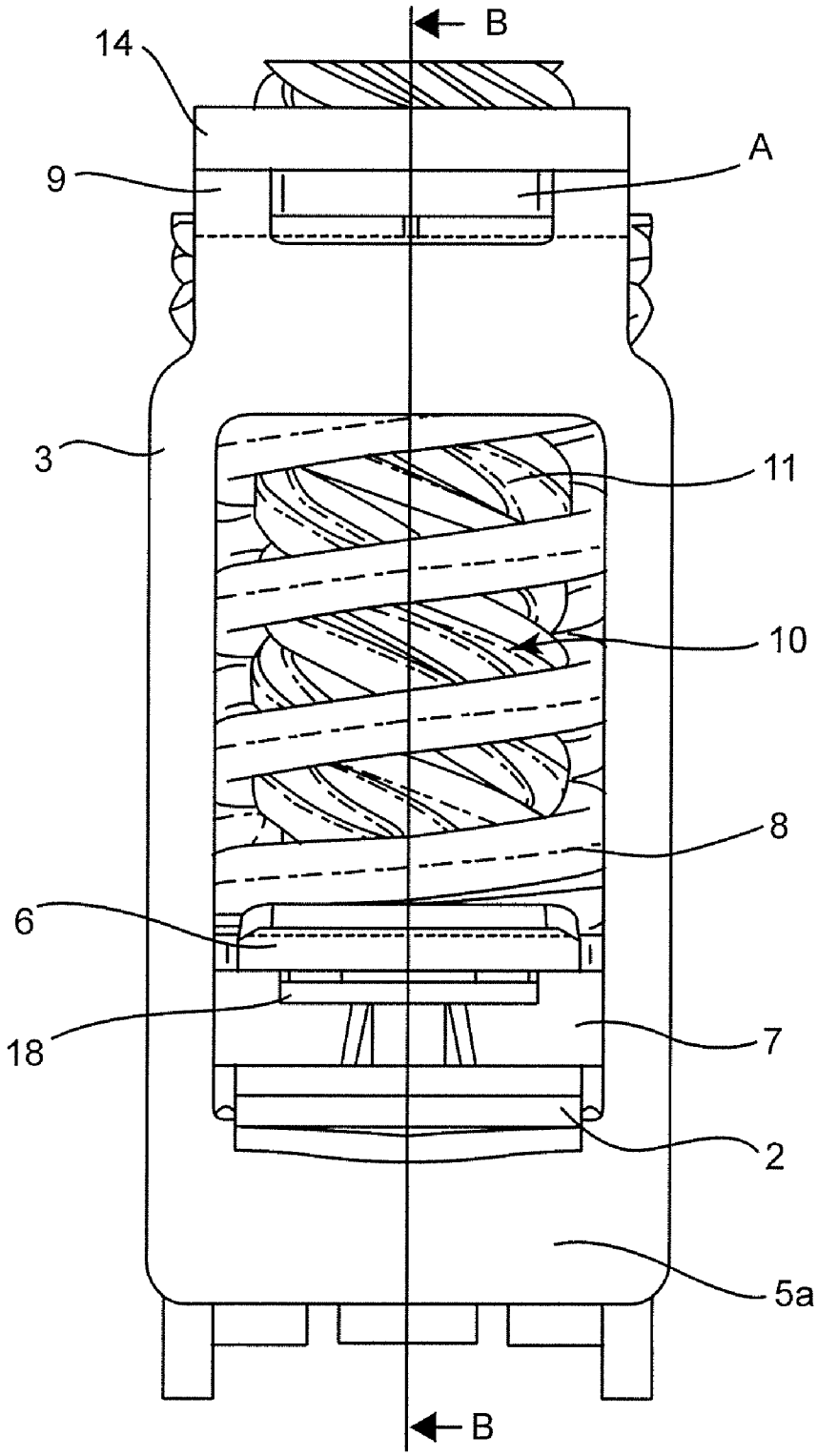
FIG. 3 shows a side view of the spring terminal element from FIGS. 1 and 2.

FIG. 3 shows a side view of a spring terminal element 1. This clearly shows a section edge B-B for definition of the section plane shown in FIG. 1.

The figure also shows that the operating cylinder 10 is guided in the internal area of the helical spring 8.

FIGS. 1 and 3 also show that a leaf spring 18 is arranged in the connecting area 7 on the lower face of the metal tunnel sheet, and exerts a spring force on a contact pin which has been inserted into the connecting area 7. By way of example, a contact pin such as this may be a contact shoe, with a rectangular or oval cross section, of a lateral bridge.

Figure 4:
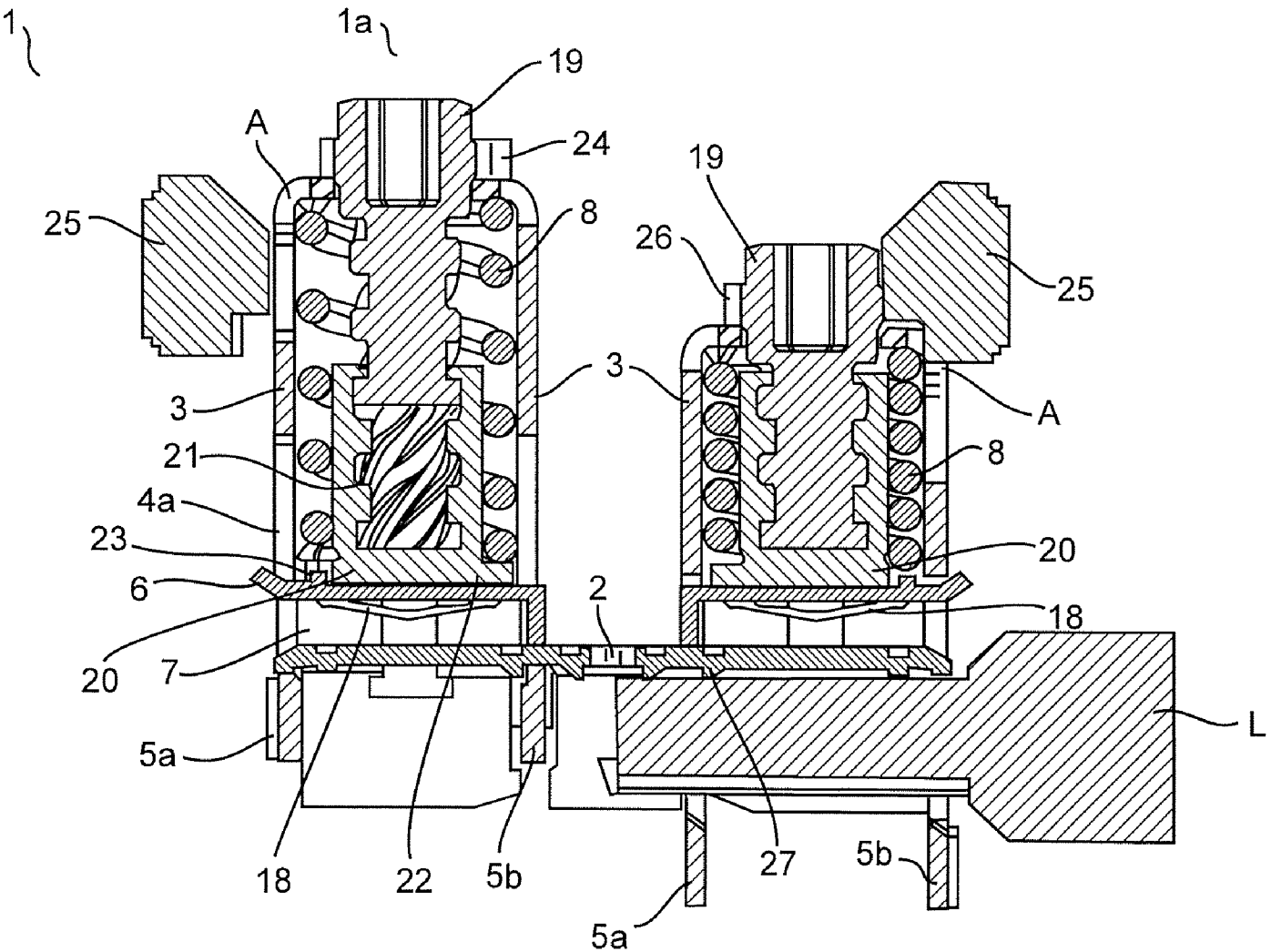
FIG. 4 shows a front section view through a second embodiment of two spring terminal elements, which are arranged on a common busbar piece, in the unoperated state or operated state.

FIG. 4 shows a second embodiment of a spring terminal element 1. In this case as well, two spring terminal elements 1*a*, 1*b* are arranged in a common busbar piece 2. While the left-hand spring terminal element 1*a* is in the closed state, the right-hand spring terminal element 1*b* is in the open state, with the helical spring 8 compressed, such that an electrical conductor to be connected, or a core end sleeve of an electrical conductor, can be inserted or removed.

In this embodiment of the spring terminal element 1, an operating cylinder 19 is once again mounted on the tensioning bracket 3 such that it can rotate, and its screw thread 11 extends into the internal area of the helical spring 8.

Furthermore, a sleeve 20 having an internal thread 21 is provided, and rests on the metal tunnel sheet 6. The free end of the operating cylinder 19 extends into the internal area of the sleeve 20, as a result of which the screw thread 11 on the operating cylinder 19 engages with the screw thread 21 on the sleeve 20. In this way, the sleeve 20 provides an operating section for an operating member which is formed from the sleeve 20 and the operating cylinder 19.

At the lower end, the sleeve 20 has a circumferential projection 22 (flange), on which the lower end of the helical spring 8 rests. Furthermore, a pin 23 projects upward from the metal tunnel sheet 6 and engages in a recess in the projection 22, thus fixing the sleeve 20 to the metal tunnel sheet 6 such that they cannot rotate with respect to one another. The projection 22 may also be a rectangular flange, whose side walls are supported on the insulating material housing 30 or the tensioning bracket 30, thus preventing a rotary movement.

In the area of the upper end, the operating cylinder 19 likewise has a circumferential projection 24, which rests on the terminating wall 9 of the tensioning bracket 3. In this way, the operating cylinder 19 is screwed into the sleeve 20 during rotation of the operating cylinder 19, and the tensioning bracket 3 is moved downward in the direction of the busbar piece 2, with the helical spring 8 being compressed.

It is also clear that the metal tunnel sheet 6 has a section which extends at a distance from and parallel to the busbar piece 2, and this provides a connecting area between the adjacent busbar piece section and the opposite inner wall of the metal tunnel sheet 6. A leaf spring 18 is once again arranged on the lower piece of the metal tunnel sheet, in order to make contact by spring force with a contact pin, for example of a lateral bridge, which has been inserted into the connecting area 7.

As can be seen from the illustration of the operated spring terminal element 1*b* on the right-hand side in FIG. 4 that, when the clamping point is open, the helical spring 8 is compressed. For this purpose, the screw thread 11 on the operating cylinder 19 is screwed virtually completely into the sleeve 20. In this end position with the clamping point open, the operating cylinder 19 would be rotated by the force of the helical spring 8, thus ensuring that the clamping point is closed and that the operating cylinder 19 is screwed out of the sleeve 20. In order nevertheless to allow an electrical conductor to be clamped in when the clamping point is open at rest, and to keep the clamping point open, a rotation block 25 is provided which movably enters a latching trough 26 in the projection 24 on the operating cylinder 19. However, this is possible only in the end position since, otherwise, the rotation block 25 would strike the tensioning bracket 3. This can be seen from the closed spring terminal element 1*a* on the left-hand side.

FIG. 4 also clearly shows that contact tabs 27 are arranged on the inner walls of the busbar piece 2 and project from the surface of the busbar piece 2, into which contact tabs 27 a core end sleeve L or an electrical conductor engages. This ensures an improved electrical contact, and ensures that the electrical conductor, if appropriate with its core end sleeve L, cannot be pulled out of the clamping point if a large pulling load is applied.

Figure 5:
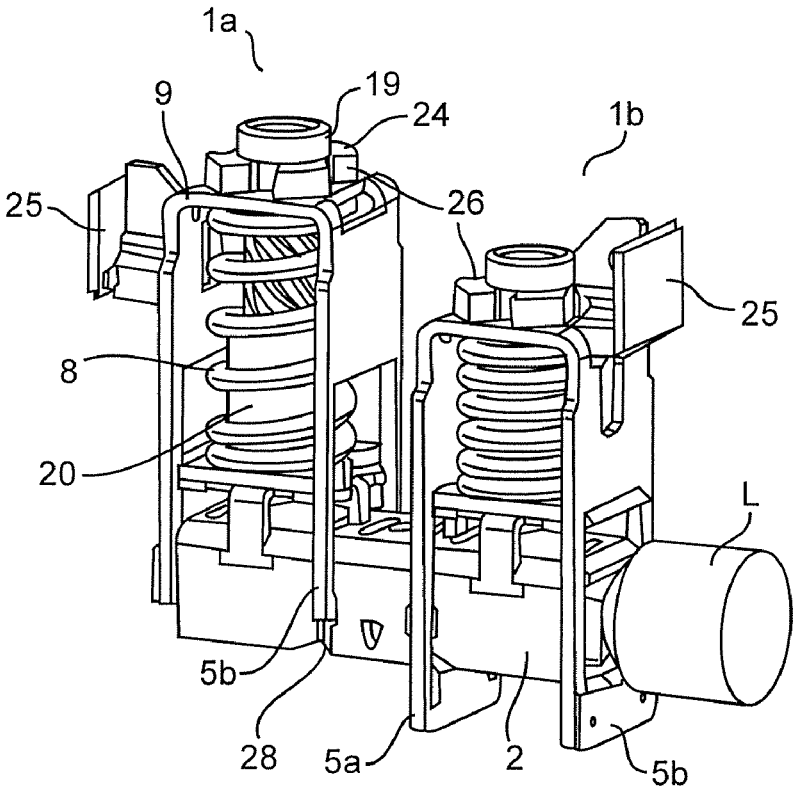
FIG. 5 shows a perspective front view of the spring terminal elements from FIG. 4.

FIG. 5 shows a perspective front view of the second embodiment of the spring terminal elements 1*a*, 1*b* as shown in FIG. 4. This illustration clearly shows that the busbar piece 2 is curved in a U-shape and has an upper wall and two opposite side walls, between which an electrical conductor, possibly with its core end sleeve L, is held.

The clamping edges 5*a*, 5*b* are guided, if required, in incisions 28 in the side walls of the busbar piece 2.

FIG. 5 furthermore clearly shows that the operating cylinder 19 has a circumferential projection 24, with latching grooves 26, at the upper end, adjacent to the upper terminating wall 9 of the tensioning bracket 3. This results in the projection 24 being star-shaped, with four projecting fingers. When the right-hand spring terminal element 1*b* is in the illustrated end position, the rotation block can then engage in the intermediate spaces between the fingers and, because the tensioning bracket 3 has been moved downward, is mounted, for example in an insulating material housing of a terminal block, such that it can move in the direction of the center axis of the operating cylinder 19.

Figure 6:
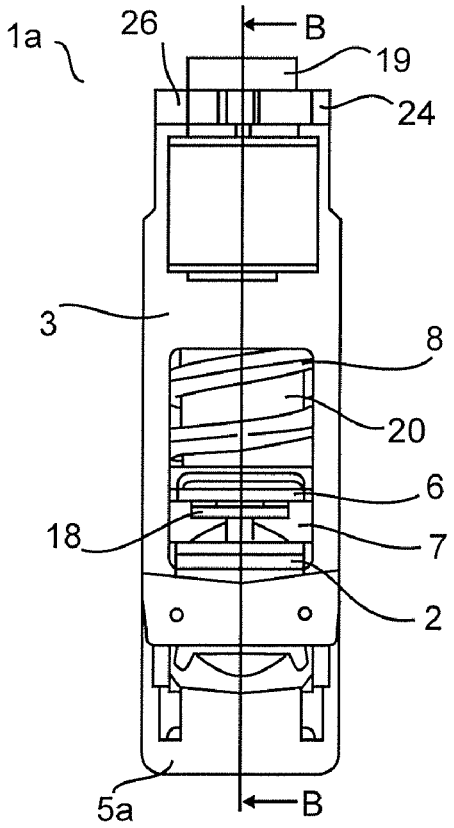
FIG. 6 shows a side view of the spring terminal element from FIGS. 4 and 5.

FIG. 6 shows a side view of the spring terminal element 1*a* from FIG. 4. The figure once again clearly shows the section line B-B, which indicates the section plane of the section view shown in FIG. 4.

It is also clear that the operating cylinder 19 now extends into the sleeve 20 in the internal area of the helical spring 8, as a result of which no additional physical space is required for the operation of the spring terminal element 1*a*.

Figure 7:
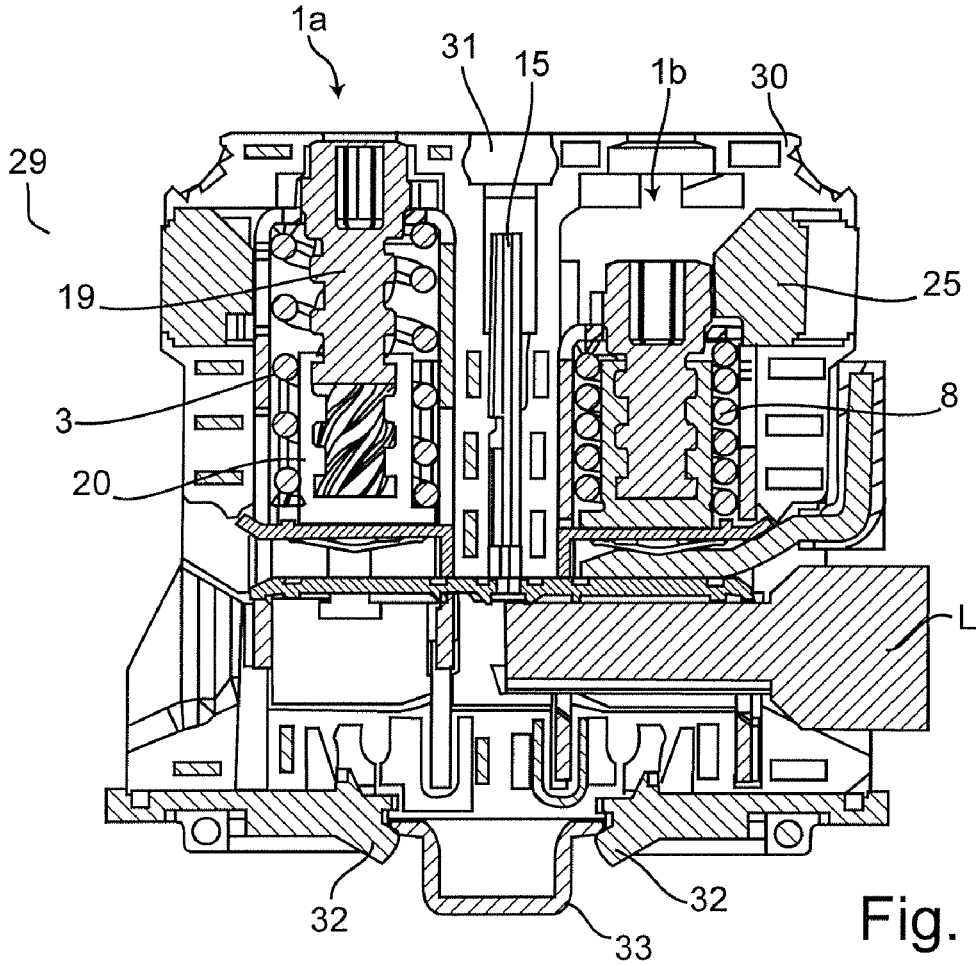
FIG. 7 shows a front view of a terminal block with the second embodiment of spring terminal elements.

FIG. 7 shows a front view of a terminal block 29 with an insulating material housing 30, in which the two spring terminal elements 1*a*, 1*b* from FIGS. 4 to 6 are installed, with a common busbar 2.

A depth stop 15 is once again passed into the insulating material housing between the two spring terminal elements 1*a*, 1*b*. In the upper end of the depth stop 15, the insulating material housing 30 has a test opening 31, in order to gain access to the upper end of the depth stop 15.

This allows the depth stop 15, which engages with the busbar 2, to be used as a test point. The depth stop 15 is furthermore used as an end stop in the busbar piece 2 for an electrical conductor, or its core end sleeve L, which has been inserted into the busbar piece 2 from an open side.

The illustration clearly shows that the terminal block 29 has a latching holder 32 in the lower area, by means of which the terminal block 29 can be latched to a mounting rail 33, in a manner known per se. Alternatively, the terminal block 29 can also be attached to a mount by a screw connection.

Furthermore, as can be seen in particular from the operating spring terminal element 1*b* on the right-hand side that the spring terminal elements 1*a*, 1*b* are self-supporting and that no significant operating force is exerted on the insulating material housing 30 during operation. In fact, the operating member, which is formed from the operating cylinder 19 and the sleeve 20 acts in the internal area of the helical spring 8 and merely exerts a force on the tensioning bracket 3 and the free end, which is adjacent to the busbar piece 2, for example to the metal tunnel sheet 6, of the helical spring 8, but not on the insulating material housing 30.

Figure 8:
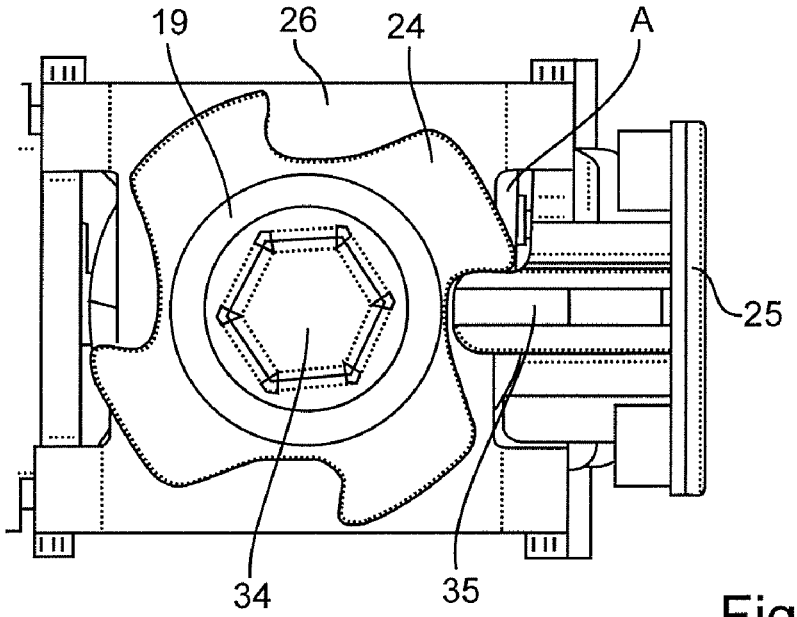
FIG. 8 shows a plan view of a projection, having latching troughs, on an operating cylinder with a rotation block.

FIG. 8 shows a plan view of a spring terminal element 1 as shown in FIGS. 4 to 7. This clearly shows the latching troughs 26 in the projection 24 of the operating cylinder 19. The operating cylinder 19 can be rotated by an operating tool, for example a hexagonal wrench or a screwdriver, which can be inserted into a hexagonal opening 34 at the upper free end of the operating cylinder 19.

As can also be seen, the rotation block 25 is moved in the direction of the center axis of the operating cylinder 19, and has a latching finger 35 which engages in a latching trough 26 in the projection 24. This prevents the operating cylinder 19 from rotating on its own, which would lead to removal of the load from the helical spring 8 and therefore to closing of the clamping point.

Figure 9:
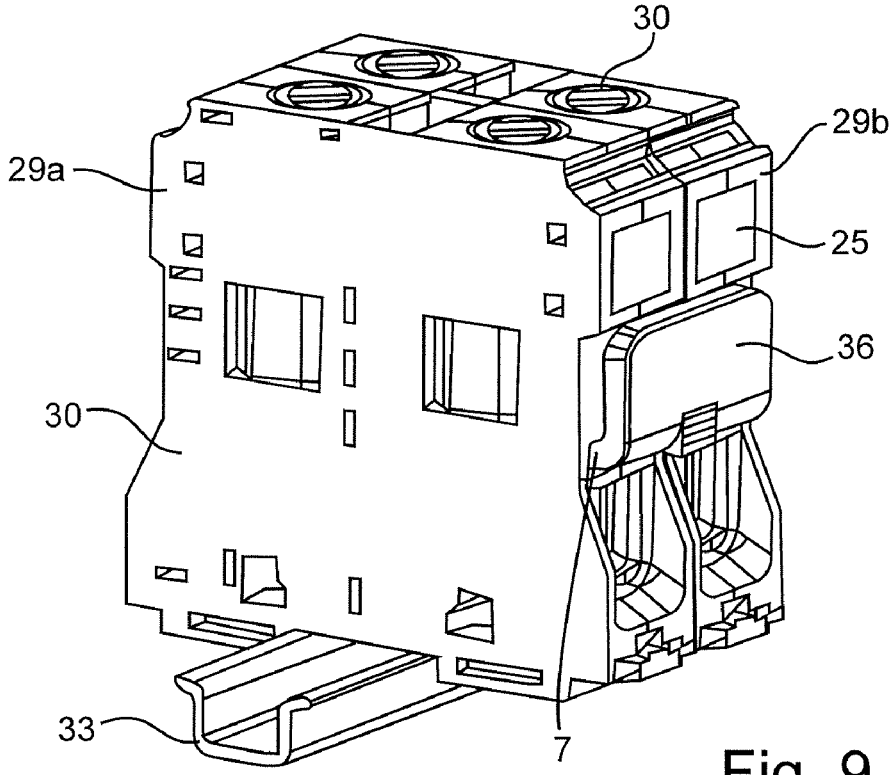
FIG. 9 shows a perspective view of two terminal blocks, which are arranged alongside one another on a mounting rail, with a lateral bridge.

FIG. 9 shows a perspective view of two terminal blocks 29*a*, 29*b*, which are arranged alongside one another on a mounting rail 33 and have the first or second embodiment of the terminal elements as described above in the internal area.

As can be seen, contact pins of a lateral bridge 36 are inserted into the connecting areas 7. This allows an electrical potential to be passed from one terminal block 29*a* to the adjacent terminal block 29*b*.

Figure 10:
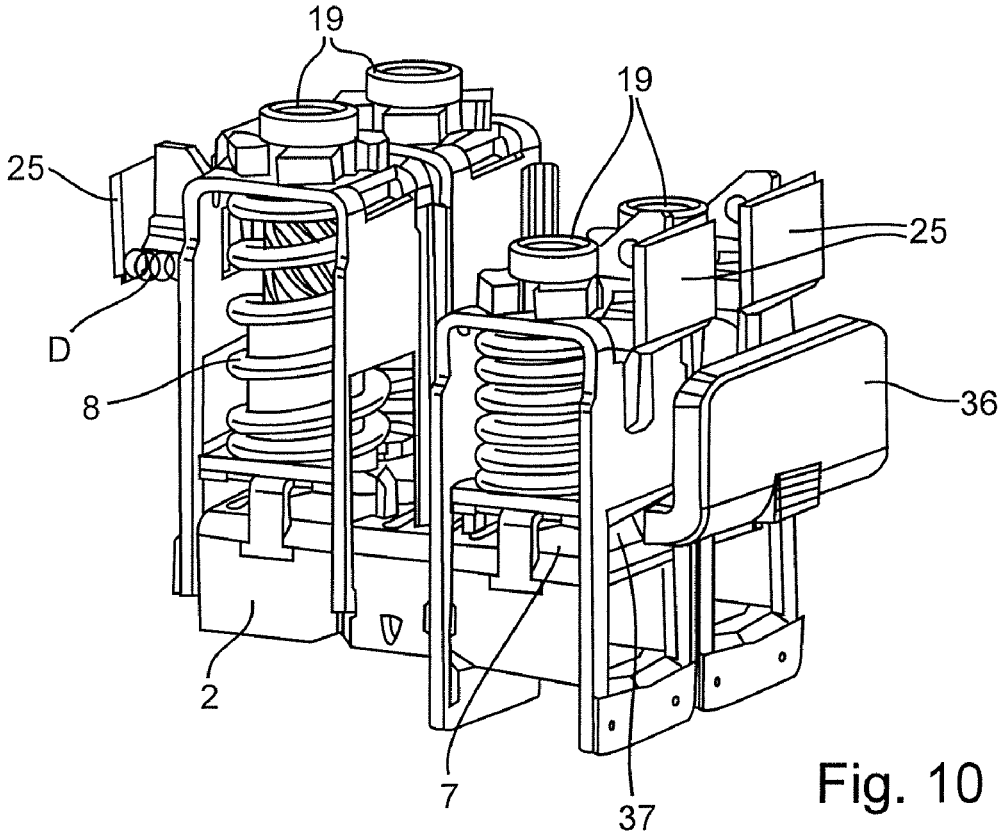
FIG. 10 shows a perspective view of two spring terminal elements, which are arranged alongside one another, in the terminal block from FIG. 9, with a lateral bridge inserted.

FIG. 10 shows more clearly the insertion of the contact pins 37 on the lateral bridge 36 into the connecting areas 7. Two terminal blocks arranged alongside one another are shown there, but without the insulating material housings, as a result of which the connecting areas 7 and contact pins 37 inserted therein are partially visible.

FIG. 9 also shows that the rotation block 25 is in each case inserted into a holding opening in the insulating material housing 30, such that the rotation blocks 25 are mounted in the insulating material housing 30 such that they can be moved in the insertion direction of an electrical conductor. The rotation block 25 is preloaded by a compression spring D (FIG. 10), in order to be pushed outward away from the operating cylinder 10, 19. For blocking, the rotation block 25 must then be pushed into the insulating material housing 30, against the spring force. In the process, the rotation block 25 is guided in a recess A in the tensioning bracket 3, in order to remove the load from the insulating material housing 30 as soon as the rotation block 25 engages in the latching trough 26 in the projection 24, and a significant force acts from the spring-loaded operating cylinder 10, 19 on the rotation block 25. In this case, the rotation block 25 is held in the blocking position by friction force, with the projection 24 being pressed against the rotation block 25.

The rotation block 25 is released by over-rotation of the operating cylinder 10, 19, by removing the friction block between the projection 24 and the rotation block 25. The rotation block 25 is then pushed outward automatically by spring force. This process is assisted by the contour of the latching trough 26.

Figure 11:
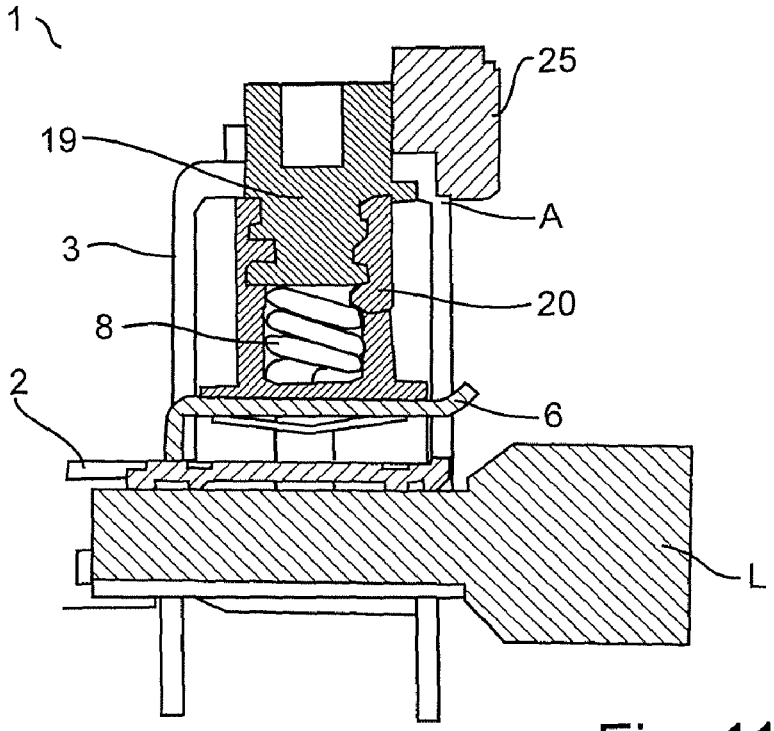
FIG. 11 shows a side view of another embodiment of a spring terminal element with a helical spring in a sleeve.

FIG. 11 shows another embodiment of a spring terminal element 1, in which the operating section 13, which is formed by a sleeve 20, rests on the metal tunnel sheet 6 of the busbar piece 2. The sleeve 20 has an internal thread, in which an external thread on an operating cylinder 19, which is supported by a flange on the tensioning bracket 3, engages. An operating section of the operating cylinder 19 projects upward through the tensioning bracket 3. A polygonal opening, for example, is introduced in the operating section, in order to allow the operating cylinder 19 to be rotated by means of a tool which is introduced into the polygonal opening and engages there.

The illustrated embodiment is distinguished in that the helical spring 8 is held in the internal area of the sleeve 20 and acts against the bottom of the sleeve 20, and against the end face of the operating cylinder 19 (threaded bolt). In the unsecured state, that is to say after unlocking the rotation block 25 and thus after releasing the tensioning bracket 3, the spring force unscrews the operating cylinder 19 ever further upward out of the sleeve 20, as a result of which the tensioning bracket 3 is moved upward and pushes the electrical conductor L against the busbar piece 2. This embodiment is distinguished by the clamping system having less friction than the solutions described above, with an external helical spring, and is suitable in particular for use when the separation width between the terminals is relatively large.

Figure 12:
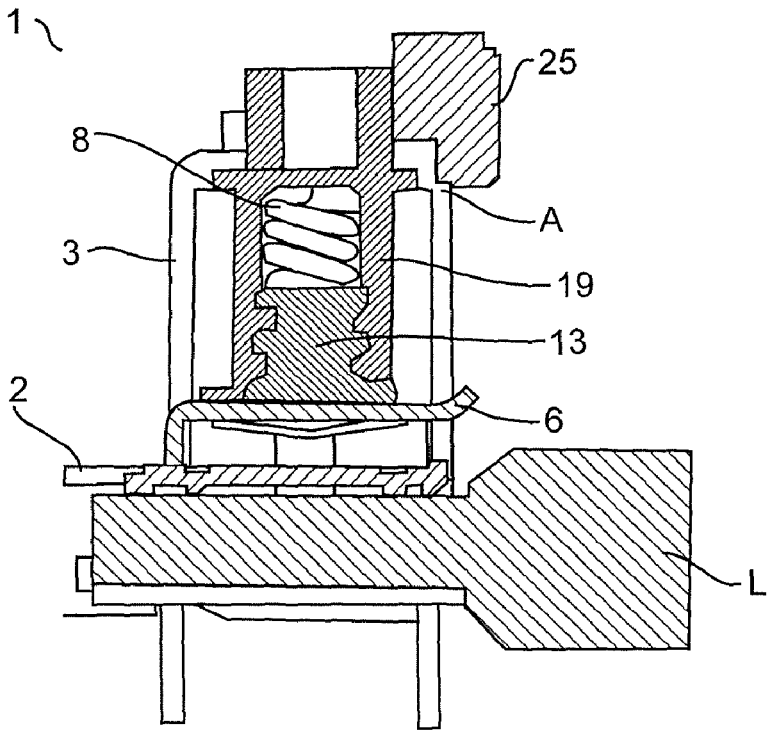
FIG. 12 shows a side view of a modified embodiment of the spring terminal element from FIG. 11.

FIG. 12 shows a modification of the embodiment shown in FIG. 11. In principle, the design and operation of the spring terminal element 1 with the helical spring 8 arranged in the sleeve 20 are the same. However, in this modification, the operating cylinder 19 is in the form of a sleeve 20 in which a threaded bolt, which forms the operating section 13, engages. The threaded bolt is supported on the metal tunnel sheet 6 of the busbar piece 2.

The invention claimed is:

1. A spring terminal element (1) having a busbar piece (2), a tensioning bracket (3), which is mounted on the busbar piece (2) such that it can move relative to the busbar piece (2) and has a clamping edge (5*a*, 5*b*), which engages under the busbar piece (2), for clamping an electrical conductor (L) between the clamping edge (5*a*, 5*b*) and the busbar piece (2), and a helical spring (8), which is operatively connected to the busbar piece (2) and to the tensioning bracket (3) and exerts a spring force between the tensioning bracket (3) and the busbar piece, wherein an operating cylinder (10, 19) with a screw thread is mounted such that it can rotate and fixed in position in the extent direction of the operating cylinder (10, 19) on the tensioning bracket (3) or on the busbar piece (2), wherein the operating cylinder (10, 19) is arranged with its screw thread (11) essentially in the internal area of the tensioning bracket (3), at least in the clamping state when it is clamped on an electrical conductor (L), and wherein the screw thread (11) on the operating cylinder (10, 19) engages with a screw thread (12) on an operating section (13), which is coupled to the tensioning bracket (3) or to the busbar piece (2), in order to move the tensioning bracket relative to the busbar piece (2) during rotation of the operating cylinder (10, 19).

2. The spring terminal element (1) as claimed in claim 1, wherein the operating section (13) has an external thread, and a sleeve (20) with an internal thread forms the operating cylinder (19), with the operating section (13) entering the sleeve (20) and its external thread interacting with the internal thread in the sleeve (20).

3. The spring terminal element (1) as claimed in claim 1, wherein the screw thread (11) on the operating cylinder (10, 19) extends into the internal area of the helical spring (8).

4. The spring terminal element (1) as claimed in claim 3, wherein the operating cylinder (10, 19) extends in the direction of the busbar piece (2) into the internal area of the helical spring (8) and is mounted on the tension bracket (3), and wherein a mating operating piece, which is axially fixed relative to the busbar piece (2) in the extent direction of the helical spring (8), extends in the opposite direction to the operating cylinder (10, 19) into the internal area of the helical spring (8), with the mating operating piece having a screw thread which engages with the screw thread (11) on the operating cylinder (10, 19).

5. The spring terminal element (1) as claimed claim 1, wherein the operating cylinder (19) has a projection (24) on its external circumference, and the tensioning bracket (3) rests on the projection (24).

6. The spring terminal element (1) as claimed in claim 5, wherein the projection (24) on the operating cylinder (19) is circumferential, and has latching troughs (26), and a rotation block (25), which can be latched into the latching trough (26), is provided in order to secure the operating cylinder (19) against rotation in at least one end position.

7. The spring terminal element (1) as claimed in claim 1, wherein the busbar piece (2) has a metal tunnel sheet (6) which is attached to a busbar piece section, producing a connecting area (7) between the busbar piece section and the inner wall, which is opposite the busbar piece section, of the metal tunnel sheet (6).

8. The spring terminal element (1) as claimed in claim 7, comprising a leaf spring (18), which is arranged in the connecting area (7), for application of a contact pressure to a contact pin which can be inserted into the connecting area (7).

9. The spring terminal element (1) as claimed in claim 1, wherein the operating cylinder (19) has an external thread, and a sleeve (20) with an internal thread forms the operating section (13), with the operating cylinder (19) entering the sleeve (20) and its external thread interacting with the internal thread in the sleeve (20).

10. The spring terminal element (1) as claimed in claim 9, wherein the sleeve (20) has a projection (22) on its external circumference, and the helical spring (8) rests on the projection (22).

11. The spring terminal element (1) as claimed in claim 9, wherein the helical spring (8) is held in the internal area of the sleeve (20) and is arranged between the free end of the operating cylinder (19), which enters the sleeve (20), and the bottom of the sleeve (20).

12. A terminal block (29) having an insulating material housing (30) and having at least one spring terminal element (1), which is held in the insulating material housing (30), as claimed in claim 1.

13. The terminal block (29) as claimed in claim 12, wherein at least two clamping points are provided on a common busbar piece (2), and are provided by in each case one tensioning bracket (3) and an operating member which is formed by an operating cylinder (10, 19) and an operating section (13, 20).

14. The terminal block (29) as claimed in claim 12, wherein a rotation block (25) is in each case mounted in the insulating material housing (30) such that it can be moved, such that the rotation block (25) engages with a latching trough (26) in the operating cylinder (19) in an end position of the tensioning bracket (3) when the helical spring (8) is prestressed.

* * * * *